United States Patent [19]

Martin, Jr.

[11] 4,192,113

[45] Mar. 11, 1980

[54] CORNER ASSEMBLY FOR WALL PANELS

[75] Inventor: Mulford Martin, Jr., Middletown, Ohio

[73] Assignee: Armco Inc., Middletown, Ohio

[21] Appl. No.: 889,351

[22] Filed: Mar. 23, 1978

Related U.S. Application Data

[63] Continuation-in-part of Ser. No. 810,310, Jun. 27, 1977, abandoned.

[51] Int. Cl.[2] ..... E04B 2/58

[52] U.S. Cl. ..... 52/282; 52/717; 52/726; 52/732; 52/463

[58] Field of Search ..... 52/280–282, 52/309.4, 309.5, 716–718, 726, 730–732, 463

[56] References Cited

U.S. PATENT DOCUMENTS

| | | | |
|---|---|---|---|
| 858,547 | 7/1907 | Thorne | 52/282 |
| 1,236,202 | 8/1917 | Murnane | 52/463 |
| 2,187,148 | 1/1940 | Fisher | 52/716 |
| 2,300,743 | 11/1942 | Hauf et al. | 52/282 |
| 2,337,885 | 12/1943 | Hallam | 52/282 |
| 3,583,118 | 6/1971 | Lowery | 52/309.5 |

FOREIGN PATENT DOCUMENTS

| | | | |
|---|---|---|---|
| 937216 | 3/1956 | Fed. Rep. of Germany | 52/280 |
| 758286 | 10/1933 | France | 52/282 |
| 1090488 | 10/1954 | France | 52/718 |
| 1291129 | 9/1972 | United Kingdom | 52/726 |

*Primary Examiner*—James L. Ridgill, Jr.
*Attorney, Agent, or Firm*—
Frost & Jacobs

[57] ABSTRACT

A covering and sealing assembly for concealing and sealing the gap between a pair of edge adjoining wall panels which are disposed at an angle to each other, such as at a corner. The assembly includes an exterior trim piece, a supporting member for the exterior trim piece, fastening means to tighten the supporting and clamping members together to squeeze the edges of the panels at the corner and to thus provide a structural tie therebetween, and an interior trim piece which snaps over the free vertical edges of the clamping member and hides the fastening means and the clamping member. The structural tie between the two corner panels is effected by the squeezing action of the legs of the supporting member and of the clamping member upon the faces of the adjoining wall panels at the points of contact between the faces and the supporting and clamping members.

31 Claims, 14 Drawing Figures

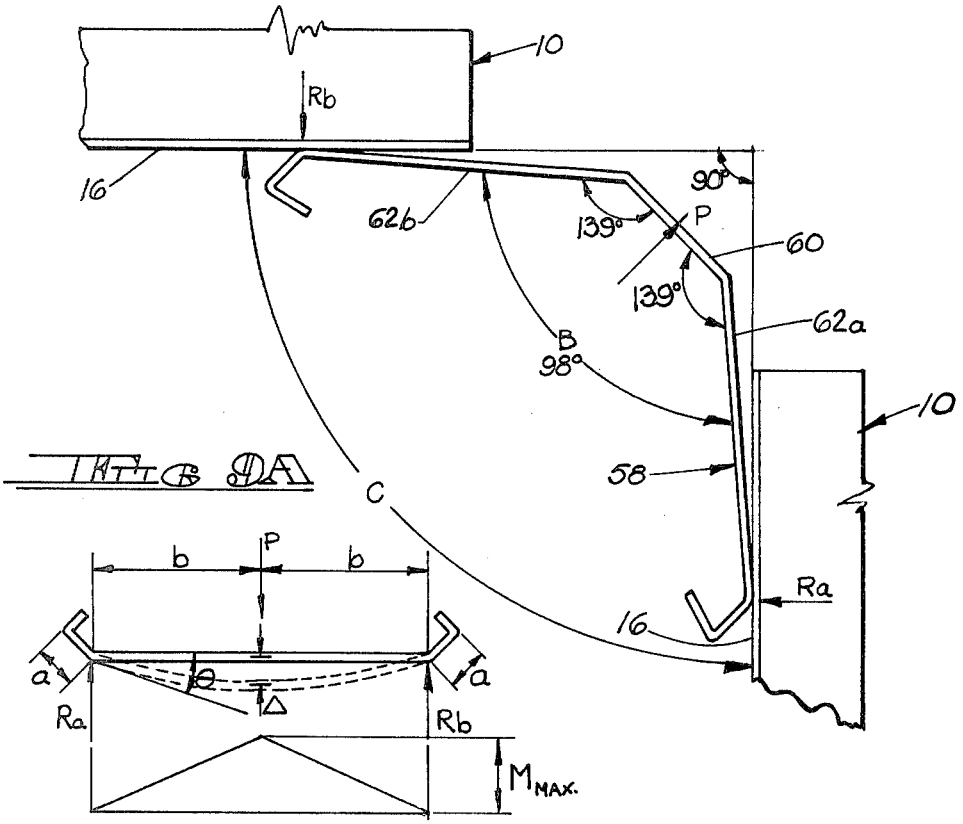
FIG 9A
FIG 9B
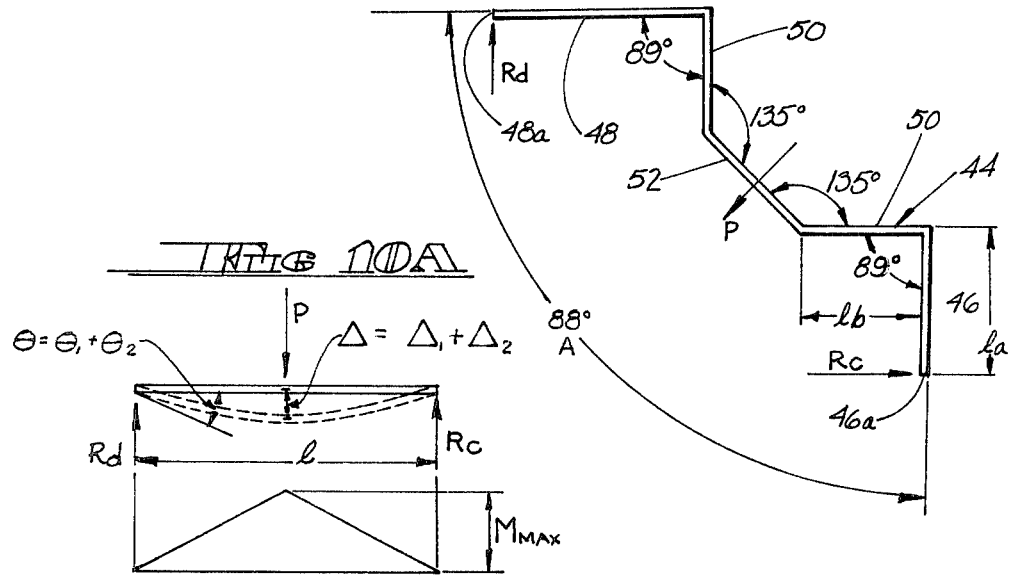
FIG 10A
FIG 10B

CORNER ASSEMBLY FOR WALL PANELS

CROSS REFERENCE TO RELATED APPLICATION

This is a continuation-in-part of application Ser. No. 810,310, filed June 27, 1977 now abandoned, in the name of Mulford Martin, Jr., and entitled "Corner Assembly for Wall Panels".

BACKGROUND OF THE INVENTION

1. Field of the Invention

This invention relates generally to building construction of the type wherein modular panels are joined to form a continuous wall, and more particularly to an improved covering and sealing assembly for corners.

2. Description of the Prior Art

In the use of conventional panels for erecting buildings and the like, difficulty has been experienced in obtaining a satisfactory corner assembly for concealing and sealing the gap between a pair of edge adjoining wall panels which are disposed at an angle to each other, such as at a corner.

While many prior art corner assemblies for joining wall panels which are disposed at an angle to each other, such as at a corner, have proven to be satisfactory in some respects, they have generally proven to be unsatisfactory, in that they have not provided a positive and adjustable fastening from inside of the building. Furthermore, splices of such assemblies have not been self-aligning. Such prior art assemblies also utilize fasteners which are exposed to the outside of the wall. Additionally, they do not provide simple erection procedure.

U.S. Pat. No. 2,337,885, in the name of C. A. Hallam, is exemplary of a further problem which is common to prior art corner assemblies for joining a pair of edge adjoining wall panels; namely, such corner assemblies do not provide an effective and satisfactory structural tie between the two adjacent panels without the aid of auxiliary means such as spacer members and roof plates which are welded to the corner posts, as required by Hallam.

Accordingly, the building industry is seeking a corner assembly for wall panels which will provide an effective and satisfactory structural tie between the two panels at the corner, without the aid of auxiliary means, while at the same time it presents a neat appearing corner closure of the same material and color as the wall panels, precludes the need for any fasteners exposed to the outside of the wall and provide simple erection procedure.

SUMMARY OF THE INVENTION

The present invention provides a covering and sealing assembly for concealing and sealing the gap between a pair of edge adjoining wall panels which are disposed at an angle to each, such as at a corner. The covering and sealing assembly includes an exterior trim piece of V-shaped cross section having two panel type legs, the free vertical edges of which are turned back upon themselves to form a return bent portion. A supporting member is provided for the exterior trim piece. The supporting member comprises first and second portions each of which is adapted to lie adjacent the legs of the exterior trim piece with the free vertical edges thereof received with the groove formed by the return bent portions of the legs of the exterior trim piece. The first and second portions are adjoined by a third portion at least a part of which is planar and lies in a plane which intersects the legs of the exterior trim piece in equal angles. The planar part of the third portion is provided with at least one opening retaining means is positioned therein.

A clamping member is provided having a central planar portion which lies in parallel relationship to the planar part of the third portion of the supporting member. The clamping member has panel type legs extending from either side of the central portion adapted to lie respectively in parallel spaced relationship to the panel legs of the exterior trim piece and to the first and second portions of the supporting member. The central portion of the clamping member is provided with an opening which corresponds to the opening in the planar part of the third portion of the supporting member, and fastener means extend through the opening in the clamping member and the opening in the supporting member into the retaining means.

When the fastening means is tightened it effects a structural tie between the pair of panels by squeezing action of the first and second portions of the supporting member and of the legs of the clamping member upon the faces of the panels at the points of contact between the faces and the supporting and clamping members. The squeezing or clamping force equals or exceeds the frictional forces between the supporting and clamping members and the surfaces or faces of the panels and effects the structural tie between the pair of panels.

In practice, it has been found that the inner face of one panel and the inner face of the other panel define a first included angle between the panels, that the first and second portions of the supporting member define a second included angle therebetween, the second included angle being less than the first included angle, and that the panel type legs of the clamping member define still a third included angle therebetween, the third included angle being greater than the first included angle. The relationship of the aforementioned first, second and third included angles allows continuous intimate contact between the inside and outside panel faces and the legs of the clamping members and the first and second portions of the supporting members, respectively.

Finally, an interior trim piece is provided which snaps over the free vertical edges of the clamping member and hides the fastener means and the clamping member.

In a preferred embodiment, insulation may be inserted between the exterior trim piece and the supporting member, and between the covering and sealing assembly and the edges of the panels to which it is attached.

In another preferred embodiment, the legs of the clamping member are fastened to their respective panels to provide additional holding of the corner assembly to the panels.

BRIEF DESCRIPTION OF THE DRAWINGS

FIG. 9A is a plan view of a clamping member of the corner assembly of the present invention showing how the clamping member may be formed.

FIG. 9B is a free body of the clamping member including a moment diagram.

FIG. 10A is a plan view of a supporting member of the corner assembly of the present invention showing how the supporting member may be formed.

FIG. 10B is a free body of the supporting member including a moment diagram.

DESCRIPTION OF THE PREFERRED EMBODIMENTS

Figure 1:
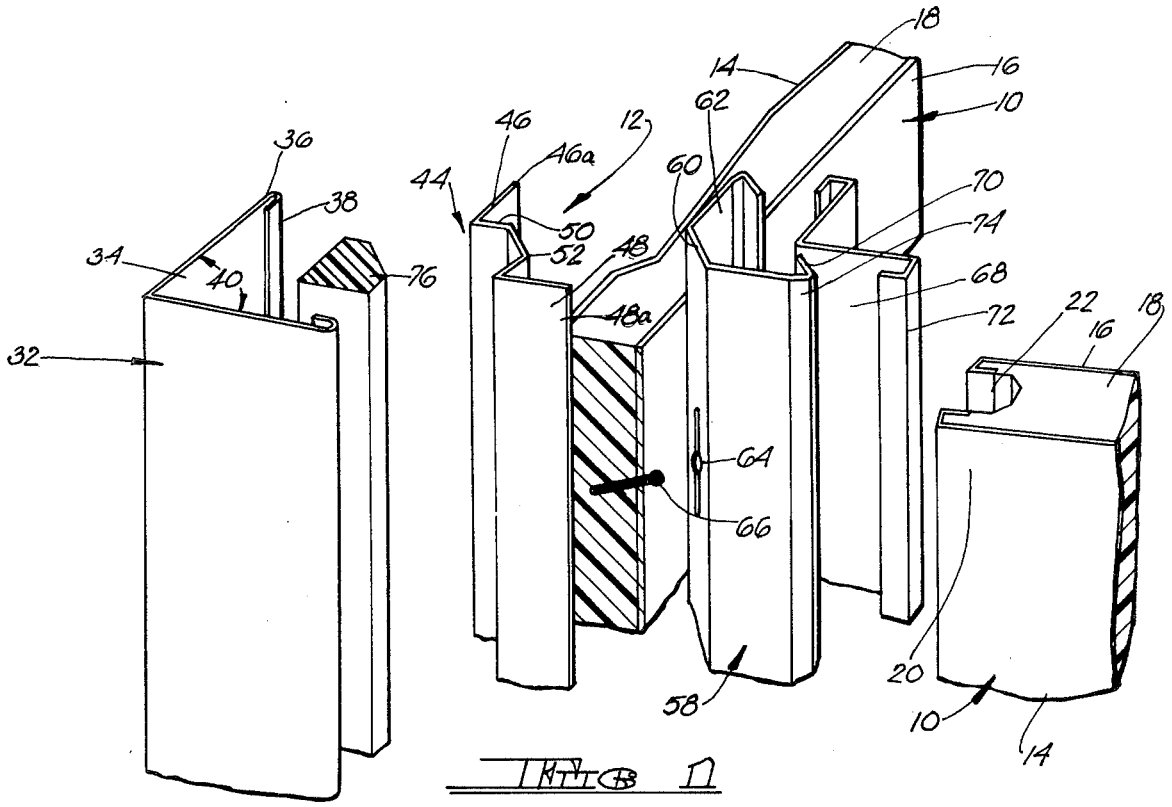
FIG. 1 is a fragmentary, exploded, prespective view showing the corner assembly of the present invention with a pair of edge adjoining wall panels which are disposed at right angles to each other.
Figure 2:
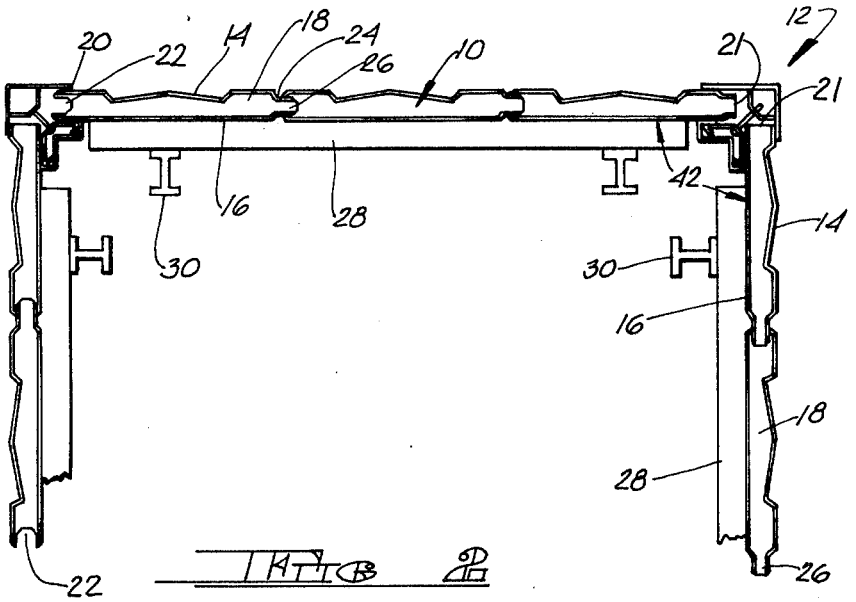
FIG. 2 is a fragmentary plan view of a building construction showing the joining of modular panels utilizing the corner assembly of the present invention.
Figure 3:
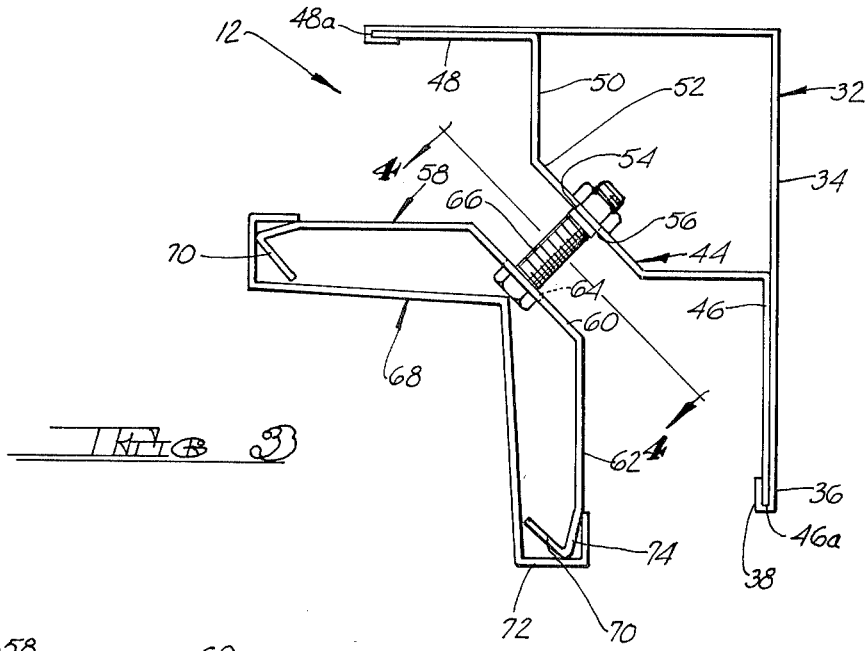
FIG. 3 is a plan view of an assembled corner assembly of the present invention.
Figure 4:
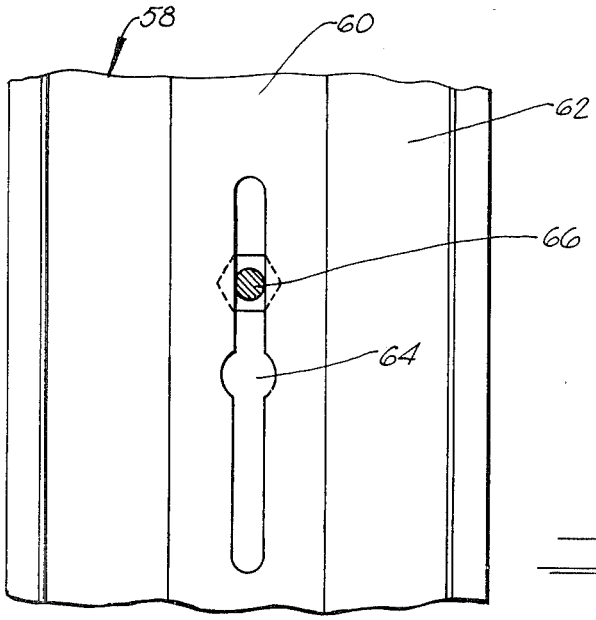
FIG. 4 is a cross sectional view taken on the line 4—4 of FIG. 3.

Referring now to the drawings, and more particularly to FIGS. 1 and 2, a plurality of panels 10 with which the corner assembly 12 of the present invention may be used, are disposed in edge-to-edge relationship. In general, each panel 10 comprises an outer metal skin 14 and an inner metal skin 16 separated by and joined to an intermediate insulating body or core element 18 substantially filling the space between the skins 14 and 16.

In practice, the insulating body or core element 18 is formed of any suitable insulating material, such as material which is light weight, fibrous or particulate aggregate held together by a binder. However, it has been found that best results are obtained when the core element 18 comprises a material characterized as integral, low density, cellular material having uniform small voids, such as, for example, urethane or polystyrene.

One edge 20 of each panel 10 is provided with a recessed groove 22 of generally U-shaped cross section forming a female member. The other edge 24 of each panel 10 is provided with an edge portion 26 of reduced thickness which forms a male member.

A building construction comprising a plurality of panels 10 is disposed in edge-to-edge relationship is shown in FIG. 2. Each panel 10 is of a width and of a length which is determined by the requirements of the building and of the location of the support frame 28, which includes the columns 30.

The corner assembly 12 of the present invention covers and seals the gap between a pair of edge adjoining wall panels 10 which are disposed at an angle to each other, such as at a corner where they may be disposed at substantially right angles. The corner assembly 12 includes an exterior trim piece 32 of V-shaped cross section having two panel type legs 34, the free vertical edges 36 of which are turned back upon themselves to form a return bent portion 38. The included angle 40 between the legs 34 of the exterior trim piece 32 is substantially identical to the included angle 42 between the panels 10 at a corner.

It will, of course, be understood that while the outer surface of the exterior trim piece 32 may be of any desired material, it is generally of the same material and color as the outer skins 14 of the panels 10.

A supporting member 44 is provided for the exterior trim piece. The supporting member 44 comprises first and second portions 46 and 48, each of which is adapted to lie adjacent the legs 34 of the exterior trim piece 32 with the free vertical edges 46*a* and 48*a* thereof, respectively, received within the groove formed by the return bent portions 38 of the legs 34 of the exterior trim piece 32. The first and second portions 46 and 48, respectively, of the supporting member 44 are joined by a third portion 50 at least a part 52 of which is planar and lies in a plane which intersects the legs 34 of the exterior trim piece 32 in equal angles. The planar part 52 of the third portion 50 of the supporting member 44 is provided with at least one opening 54 and retaining means such as the cage nut 56 are positioned therein.

A clamping member 58 is provided having a central planar portion 60 which lies in parallel relationship to the planar part 52 of the third portion 50 of the supporting member 44. The clamping member 58 has panel type legs 62 extending from either side of the central portion 60 adapted to lie respectively in parallel spaced relationship to the panel legs 34 of the exterior trim piece 32 and to the first and second portions 46 and 48 of the supporting member 44. The central portion 60 of the clamping member 58 is provided with an opening 64 which corresponds to the opening 54 in the planar part 52 of the third part 50 of the supporting member 44.

Fastening means such as the threaded bolt 66 extends through the opening 64 in the clamping member 58 and the opening 54 in the supporting member 44 into the retaining means 56 such as a cage nut or a swaged nut.

Figure 5:
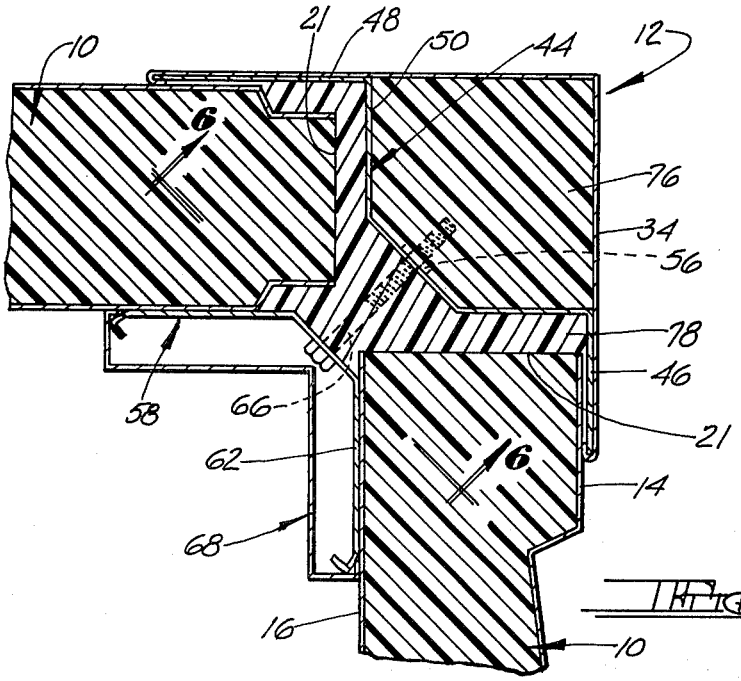
FIG. 5 is a plan view enlargement of the upper right hand corner of FIG. 2 showing insulation.

As can be seen in FIG. 5, the panels 10 at the corner are positioned such that the edges of the outer and inner skins 14 and 16, respectively, are within the opening between the spaced legs 48 and 62 and 46 and 62 of the supporting member 44 and the clamping member 58, respectively. In practice, the assembly of the exterior trim piece 32 and the support member 44 are held against the edges of the corner panel 10. A bolt 66 is then threaded into the retaining means 56. The head of the bolt 66 is then fit through the opening 64. When the bolt 66 is tightened, the legs 62 of the clamping member 58 are pressed against the inner metal skins 16 at the edges of the panels 10 at the corner which are then squeezed towards the outer skins 14 thereof, providing a structural tie therebetween.

A suitable interior trim piece 68 snaps over the free vertical edges 70 of the legs 62 of the clamping member 58 and hides the bolt 66 and the clamping member 58. As shown in the drawings, the vertical free edges 70 of the legs 62 of the clamping member 58 may be provided with flanges which contact flanges 72 on the edges of the interior trim piece 68. Additionally, the edges of the panel type legs 62 of the clamping member 58 adjacent the free vertical edges 70 thereof may be bent as at 74 to provide room for the flanges 72 of the interior trim piece 68.

As can be seen in FIG. 5, insulation such as plastic foam 76 may be inserted between the exterior trim piece 32 and the supporting member 44, and in the interstitial spaces 78 between cut edges, as at 21 the panels 10 and the corner assembly 12.

It will be understood that the central planar portion 60 of the clamping member 58 may be spaced from the planar portion 52 of the third portion 50 of the supporting member 44 when the corner assembly 12 is assembled to the panels 10. However, such spacing will, of course, depend upon the thickness of the panels 10.

Additionally holding of the corner assembly 12 to the panels 10 may be provided by securing the panel type legs 62 of the clamping member 58 to the inner skins 16 of their respective panels 10. Such securing or fastening may be accomplished by use of screws or rivets.

Figure 6:
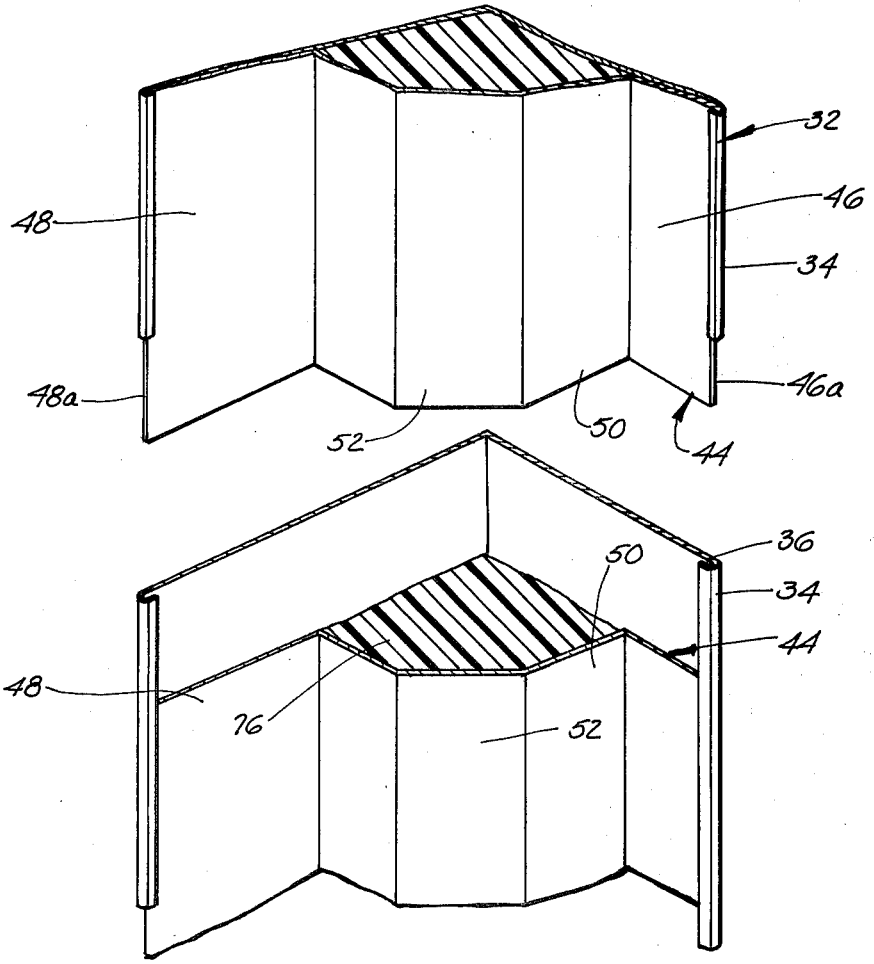
FIG. 6 is a perspective view of the splice of short pieces of the corner assembly as seen from line 6—6 of FIG. 5.

As shown in FIG. 6, the present invention contemplates that short pieces of the exterior trim piece 32 and short pieces of the support member 44 may be butt joined at their ends to match a total height of corner panels. Such splices are self-aligning because short pieces of the lower exterior trim piece 32 may be offset vertically from its supporting member 44 so that the abutting upper short piece of the supporting member 44 telescopes into the lower exterior trim piece 32 and both are clamped by the clamping member 58.

As shown in FIG. 2, it will be noted that for the right hand corner, both the male edge portion 26 of a first panel 10 and the female edge 20 of a second panel 10 have had portions, as at 21, of the panels removed or cut off prior to utilization of the corner assembly 12 of the present invention. This may be done when required to result in the proper wall length. In the left hand corner of the building construction of FIG. 2, the male edge portion 26 of a first panel 10 has again been partially removed while the female edge 20 of the second panel 10 is used whole.

Figure 7A:
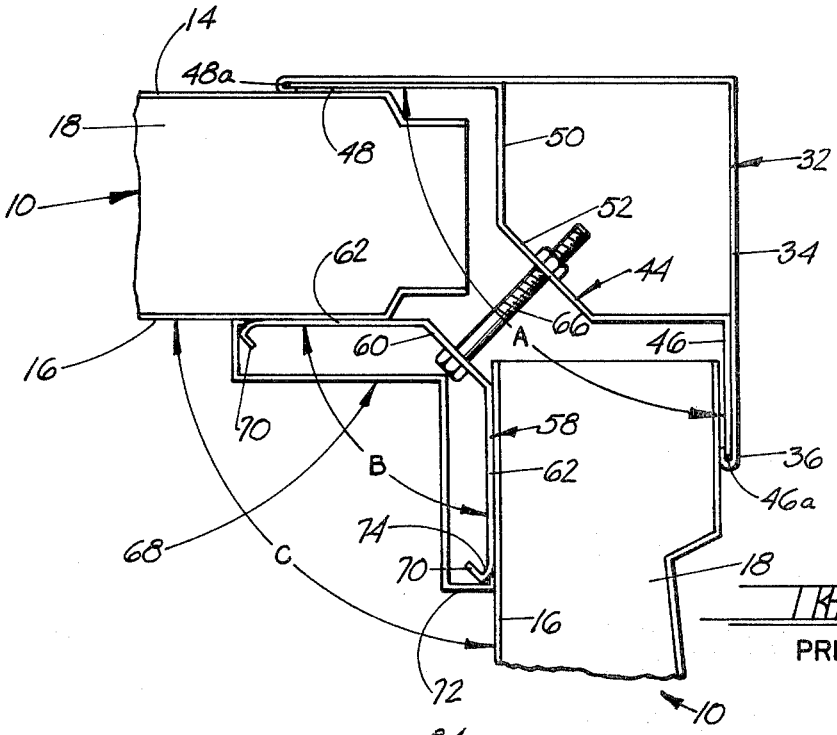
FIG. 7A PRIOR ART
FIG. 7A is a plan view enlargement of a corner similar to the upper right hand corner of FIG. 2 showing a corner assembly which does not provide a structural tie between a pair of edge adjoining wall panels when this assembly is in the untightened position.

As previously indicated, prior art corner assemblies do not provide an effective and satisfactory structural tie between the two adjacent panels being joined without the aid of auxiliary means such as spacer members and roof plates which are welded to, for example, a corner post. In this regard, FIG. 7A is a plan view enlargement of a corner similar to the upper right hand corner of FIG. 2 showing a corner assembly of the present invention which does not provide a structural tie between a pair of edge adjoining wall panels 10 when the assembly is in the untightened position. As can be seen, the included angle A, defined by the first and second portions 46 and 48, respectively, of the supporting member 44, and the included angle B, defined by the panel type legs 62 of the clamping member 58, are substantially identical to the included angle C, defined by the surfaces or faces of the inner metal skin 16 of the panels 10. For simplicity, the angle C has been shown as 90°.

Figure 7B:
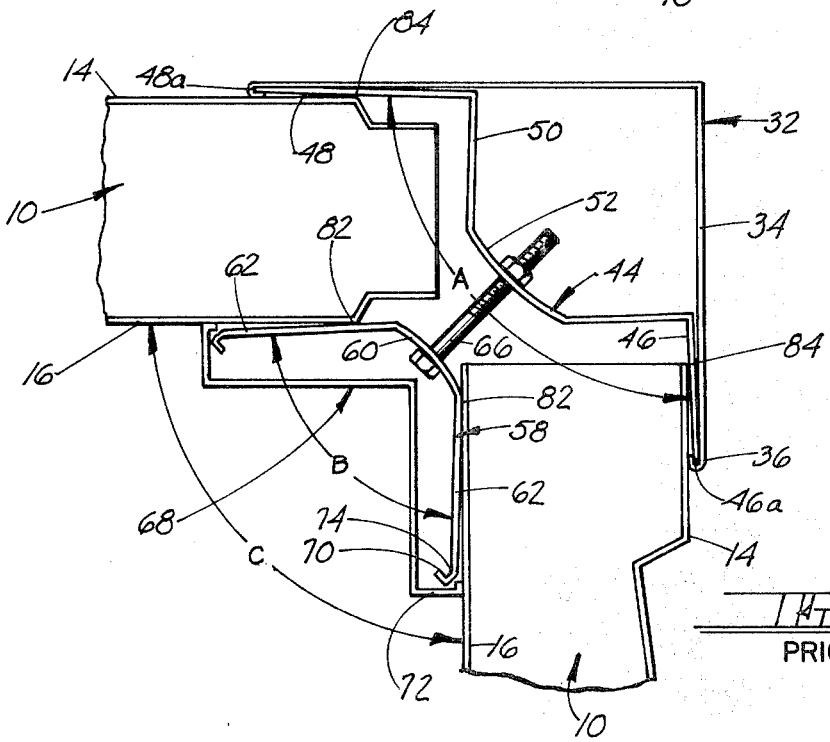
FIG. 7B PRIOR ART
FIG. 7B is a Figure similar to FIG. 7A when the assembly is in the tightened position.

FIG. 7A shows the relationship of a supporting member 44 having a 90° included angle A and a clamping member 58, also having a 90° included angle B, to the building panels 10, also a 90° included angle C, before the threaded bolt 66 is tightened into the retaining means 56. As can been seen, the surfaces or faces of the outer metal skins 14 are in intimate contact with the first and second portions 46 and 48, respectively, of the supporting member 44. Likewise, the surfaces or faces of the inner skins 16 of the panels 10 are in intimate contact with the panel type legs 62 of the clamping member 58. However, as shown in FIG. 7B, when the threaded bolt 66 is tightened into the retaining means 56, the supporting and clamping members 44 and 58 tend to be pulled into the juncture between the building panels 10. Note that the planar portions 52 and 60 of the supporting and clamping members 44 and 58, respectively, tend to become bowed. Accordingly, as can be seen, the legs 62 of the clamping member 58 no longer contact the surface or face of the inner metal skins 16 of the panels 10 except at the points of contact 82. Similarly, the legs 46 and 48 of the supporting members 44 no longer contact the surface or face of the outer metal skins 14 of the panels 10 except at the points of contact 84.

It has been determined that the corner assembly 12 of the present invention will provide an effective and satisfactory structural tie between the pair of panels 10 by squeezing action of the first and second portions 46 and 48, respectively, of the supporting member 44, and of the legs 62 of the clamping member 58, upon the surface or face of the outer and inner metal skins 14 and 16, respectively, at the points of contact between the skins 14 and 16 and the supporting and clamping members 44 and 58, respectively, if the included angle A, defined by the first and second portions 46 and 48 of the supporting member 44, is less than the included angle C, defined by the surfaces or faces of the inner metal skin 16 of the panels 10; and further, if the included angle B, defined by the panel type legs 62 of the clamping member 58, is greater than the angle C. In the exemplary illustration of FIG. 8A, the included angle A is 88°, the included angle B is 98°, and the included angle C is 90°.

Figure 8A:
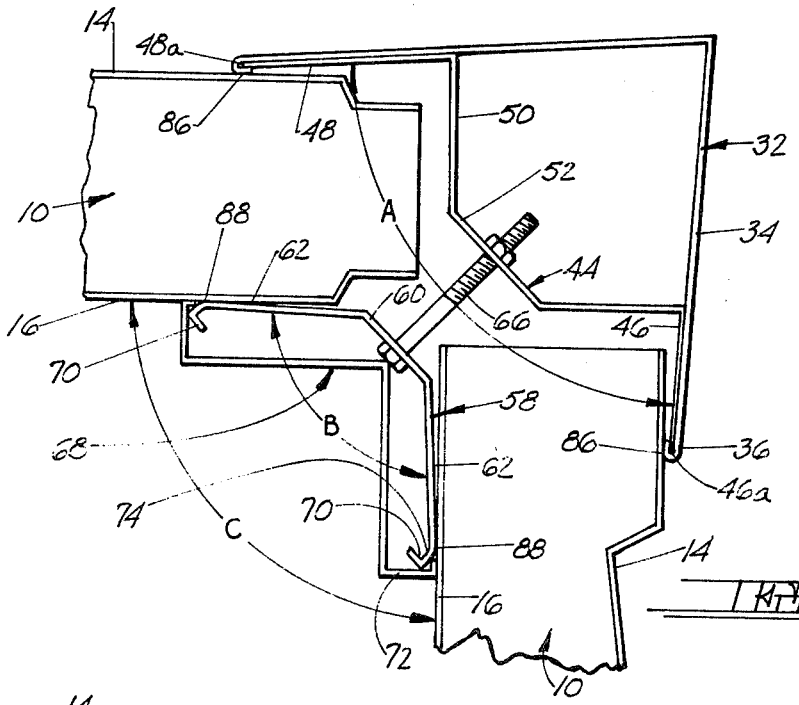
FIG. 8A is a plan view enlargement of the upper right hand corner of FIG. 2 showing a corner assembly which does provide a structural tie between a pair of edge adjoining wall panels when this assembly is in the untightened position.

When the corner assembly 12 of FIG. 8A is assembled, and before the threaded bolt 66 is tightened, it will be noted that there is only contact between the first and second portions 46 and 48 of the supporting member 44 and the surface or face of the outer skin 14 of the panels 10 at the points 86. Similarly, there is only contact between the legs 62 of the clamping member 58 and the surface or face of the inner metal skin 16 of the panels 10 at the points 88.

Figure 8B:
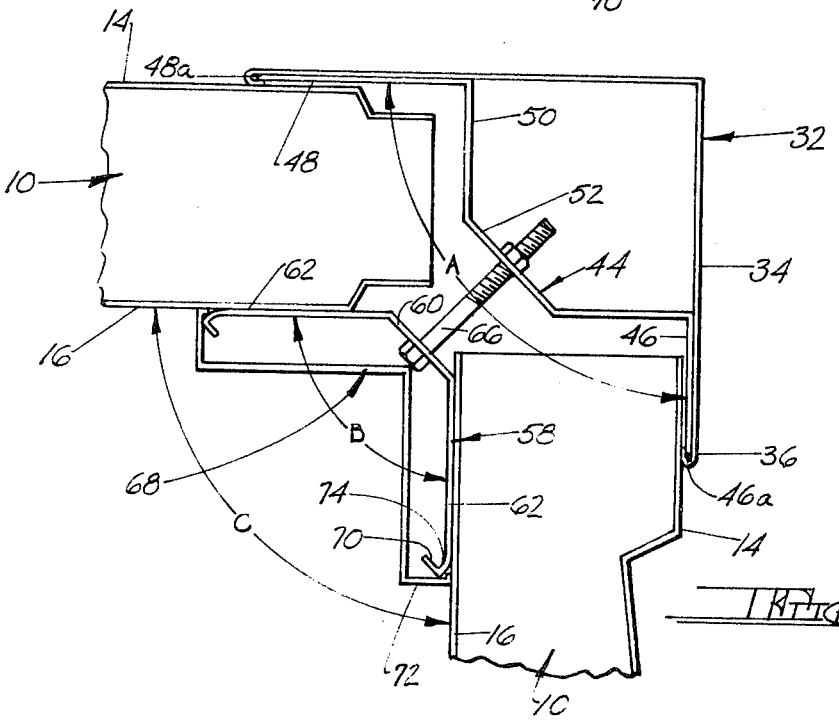
FIG. 8B is a Figure similar to FIG. 8A when this assembly is in the tightened position.

As the threaded bolt 66 is gradually tightened, the supporting and clamping members 44 and 58 are gradually pulled into the juncture between the panels 10. When sufficient force has been applied, as shown in FIG. 8B, continuous intimate contact results between the first and second portions 46 and 48 of the supporting member 44 and the surface or face of the outer metal skins 14 of the panels 10 as well as between the legs 62 and the surface or face of the inner metal skins 16 of the panels 10. It has been found that the squeezing or clamping force should equal or exceed the frictional forces between the supporting and clamping members 44 and 58 and the surfaces of the outer and inner skins 14 and 16 of the panels 10 in order to effect the structural tie between the pair of panels 10. Accordingly, the corner assembly 12 of the present invention thus achieves an effective and satisfactory structural tie between the adjoining panels 10.

It should, of course, be noted that when the person installing the corner assembly 12 sees the condition of the corner assembly 12 in relation to the panels 10 shown in FIG. 8B, tightening of the threaded bolt 66 should cease. If tightening of the threaded bolt 66 continues, the supporting and clamping members 44 and 58 will continue to be pulled into the juncture between the panels 10 until only point contact exists between the first and second portions 46 and 48, as well as the leg 62 of the clamping member 58, and the panel surfaces, as shown in FIG. 7B. Should this occur, the threaded bolt 66 should be backed off in order to decrease the force until continuous intimate contact results between the components of the assembly and the surfaces of the panel skins.

The included angles A and B of the supporting and clamping members 44 and 58, respectively, may be determined by calculations examples of which will more fully be explained hereinafter. However, it will, of course, be understood that the included angles A and B will vary depending upon corner assembly application as well as upon many variables, including the included angle C, defined by the surfaces or faces of the inner metal skins 16 of the panels 10, the thicknesses, dimensions and material of the supporting and clamping members 44 and 58, the frictional forces between the supporting and the clamping members 44 and 58 and the skins 16 of the panels 10, etc.

Turning now to FIGS. 9A and 9B, the calculation of the included angle B will be explained.

A plan view of a clamping member 58 is shown in FIG. 9A. The included angle B, defined by the legs **62*a* and 62*b*, is shown as 98°, which is greater than the 90° included angle C between the inner metal skins 16 of the panels 10**. An example of the method of calculating the required included angle B, which is in fact 98° when the included angle C is 90°, may be as follows:

Assumptions:

1. P=the allowable force exerted by the fastening means 66.
2. $R_a=R_b$=the force exerted by the clamping member 58 against the faces or surfaces of the inner metal skins 16 of the panels 10.
3. The force P is equidistant between $R_a$ and $R_b$.
4. The clamping member 58 is formed from steel whose modulus of elasticity E is $29\times10^6$ psi; $F_Y$=50,000 psi; and whose thickness is 0.06 inches.
5. A factor of safety of 1.67:

The section modulus S of the cross section of the clamping member 58 may be calculated as follows:

$$S=(b\times d^2)/6,$$

where b=A one inch width of the section and d=0.06 inch, the thickness of the clamping member 58.

The force $R_a=R_b$ may be computed by applying the load P to a beam whose length L is the distance between $R_a$ and $R_b$, as shown in FIG. 9B.

The maximum allowable moment, as shown in FIG. 9B, may be calculated as follows:

$$M_{Max} = Sf, \text{ where } f = \frac{F_Y}{\text{Factor of Safety}} = \frac{F_y}{1.67} = 0.6F_y = 30{,}000 \text{ psi.}$$

The actual moment, Ma=PL/4.

Equating $M_{Max}=M_a$ $$Sf=(P\times L)/4$$

Solving for P $$P=4Sf/L=4db^2f/6L$$

Assuming L=5.75 inches for this particular corner assembly, P is calculated to be 12.52 pounds per inch of section length and $R_a$ is calculated to be 6.26 pounds per inch of section length.

The deflection of the legs **62*a* and 62*b*** will be equal if the lengths of the legs are equal, and may be computed as follows:

$$\Delta = \frac{PL^3}{48\,EI}, \text{ where } I = S\left(\frac{d}{2}\right) = \frac{bd^3}{12} = 0.095 \text{ inches}$$

The tangent to the curve of the deflected beam at the supports $R_a$ and $R_b$, as best seen in FIG. 9B, forms an angle $\theta$ with a straight line between $R_a$ and $R_b$.

$$\theta = \frac{1}{16}\,\frac{PL^2}{EI} = \frac{\Delta}{\frac{2L}{6}} = \frac{3\Delta}{L} = \text{each end of the beam.}$$

The total included angle B between the legs **62*a* and 62*b* of the clamping member 58** is $90°+2\theta=95°\ 41'$. In practice this is rounded off to 96°, and allowing a +2° tolerance for manufacturing, a 98° angle is specified.

In summary, the clamping member 58 is formed to an included angle B of 98° between the legs **62*a* and 62*b***.

Turning now to FIGS. 10A and 10B, the calculation of the included angle A will be explained.

A plan view of a supporting member 44, without the exterior trim piece 32, is shown in FIG. 10A. The included angle A, defined by the legs 46 and 48 of the supporting member 44, is shown as 88°, which is smaller than the 90° included angle C between the inner metal skins 16 of the panels 10. An example of the method of calculating the required included angle A, which is in fact 88° when the included angle C is 90°, is similar to that for calculating included angle B of the clamping member 58.

The free vertical edges **46*a* and 48*a* of the legs 46 and 48, respectively, of the supporting member 44 are in contact with the outer metal skins 14 of the panels 10 of the assembly, and exert forces $R_c$ and $R_d$, respectively, upon the skins 14 of the panels 10. The free body cross section acts as a beam of length L, the composite length of the supporting member 44, with a load P exerted by the fastening means 66. Assuming that the supporting member 44 is formed of the same material as the clamping member 58** and that the other assumptions are also identical, the calculations of the allowable loads $R_c$ and $R_d$ are as follows:

$$M_{Max} = Sf = M_a = \frac{PL}{4}$$

$$P = 4\frac{Sf}{L} = \frac{4db^2F}{6L}$$

Assume L=10 inches for this particular corner assembly and $R_c=R_d=P/2=3.6$ pounds per inch.

The support member 44 is continuous over the total length of the surfaces of the outer metal skins 14 of the panels 10, whereas the clamping member 58 may not necessarily be continuous over the total length of the surfaces of the inner metal skins 16 of the panels 10. If the clamping member 58 is assumed to contact the surfaces of the inner metal skins 16 of the panels 10 at 62.5% of the length of the panels 10 (panels 15 inches long on center every 24 inches or $15/14\times100$), then the squeezing action of the supporting and clamping members 44 and 58 cannot exceed the force $R_a$ exerted by the clamping member 58 multiplied by 0.625.

$$R_c = R_d \approx 0.625\ R_a = 0.625\ R_b.$$
$$0.625\ R_a = 3.9 \text{ pounds} \approx R_c = 3.6 \text{ pounds.}$$

In general the legs 46 and 48 of the support member 44 will deflect first, since they are shorter than the third portions 50 and the planar portion 52.

Assume $L_a$=the lengths of each of the legs 46 and 48=2.375 inches for this particular corner assembly and the deflection of each of the legs 46 and 48 under a load P of 12.52 pounds, exerted by the fastening means 66 through the clamping member 58, equals:

$$\Delta_1 = \frac{PL_a^3}{48\ EI} = 0.0066 \text{ inches}$$

$$\theta_1 = \frac{3\Delta_1}{L_a} = 0.0083 \text{ Radians} = 0^\circ\ 28'$$

at the intersection of the leg 46 and the third portion 50 and at the intersection of the leg 48 and the third portion 50.

As the supporting member 44 deflects under additional load P, the third portions 50 begin to deflect, and with their lengths $L_b$, which are assumed to be 1.75 inches for this particular corner assembly, the deflection will be:

$$\Delta_2 = \frac{PL_b^3}{48\ EI} = 0.0027 \text{ inches}$$

$$\theta_2 = \frac{3\Delta_2}{L_b} = 0.0046 \text{ Radians}$$

$$\theta_2 = 0^\circ\ 15''$$

at the intersection of the planar portion 52 and each of the third portions 50 of the supporting member 44.

The total deflection $\theta$, as best seen in FIG. 10B, is the sum of the deflection angles $\theta_1+\theta_2$, or 0° 43′, which is rounded off as 1°. Allowing for manufacturing tolerances, each angle between the third portions 50 and either leg 46 or 48 is made 1° less than 90°, or 89°. Accordingly, from simple trigonometric relationships, it may readily be determined that the included angle A, defined by the legs 46 and 48 of the supporting member 44, is 88°.

The corner assembly 12 of the present invention provides an effective and satisfactory structural tie between the edge of two adjoining panels 10 at a corner of a building. Such panels 10 are generally (but not necessarily) at right angles to each other. The corner assembly 12 presents a neat appearing corner closure of the same material and color as the wall panels 10 and precludes the need for any fasteners exposed to the outside or inside of the panel walls. The structural strength provided by the corner assembly 12 of the present invention provides structural continuity around the corner. The corner assembly 12 of the present invention allows for slight variation of corner panel position off width module. Furthermore it provides ability to seal the corner panel joint against moisture and air leakage. Further benefit results when insulation is utilized since the corner assembly 12 will then provide insulation continuity of panels at the corner. The corner assembly 12 of the present invention provides a positive and adjustable fastening from the inside of buildings and it may be erected in sequence with wall panels or after wall panels are in place.

While certain preferred embodiments of the present invention have been specifically illustrated and described, it is understood that the invention is not limited thereto, as many variations will be apparent to those skilled in the art, and the invention is to be given its broadest interpretation in the terms of the following claims.

The embodiments of the invention in which an exclusive property or privilege is claimed are defined as follows:

1. In a corner and sealing assembly for the corner of a building of the type having a pair of panels angularly disposed in edge-to-edge relationship, each panel comprising an outer metal skin and an inner metal skin separated by and joined to an intermediate insulating body substantially filling the space between said skins, an exterior trim piece of V-shaped cross section having two panel type legs, the free vertical edges of which are turned back upon themselves to form a return bent portion; a supporting member for said exterior trim piece, said supporting member comprising first and second portions each of which is adapted to lie adjacent said legs of said exterior trim piece with the free vertical edges thereof received within the groove formed by said return bent portions of said exterior trim piece, said first and second portions being joined by a third portion at least a part of which is planar and lies in a plane which intersects said legs of said exterior trim piece in equal angles, said planar part of said third portion being provided with at least one opening; retaining means positioned in said opening of said planar part of said third portion of said supporting member; a clamping member having a central planar portion which lies in parallel relationship to said planar part of said third portion of said supporting member, said clamping member having panel type legs extending from either side of said central planar portion adapted to lie respectively in parallel spaced relationship to said panel type legs of said exterior trim piece and to said first and second portions of said supporting member, said central planar portion of said clamping member being provided with at least one opening which corresponds to said opening in said planar part of said third portion of said supporting member; the inner metal skin of one panel and the inner metal skin of the other panel defining a first included angle between said panels, said first and second portions of said supporting member defining a second included angle therebetween, said second included angle being less than said first included angle, and said panel type legs of said clamping member defining a third included angle therebetween, said third included angle being greater than said first included angle; and fastening means extending through said opening in said clamping member and said opening in said supporting member into said retaining means, whereby the tightening of said fastening means effects a structural tie between said pair of panels by squeezing action of said first and second portions of said supporting member and said legs of said clamping members upon said outer and inner metal skins of said panels, respectively, at the points of contact between said skins and said supporting and clamping members, with the force of said squeezing action being substantially equal to or exceeding the frictional forces between said supporting and clamping members and said outer and inner metal skins respectively, when intimate contact results therebetween.

2. The building construction according to claim 1, wherein said central planar portion of said clamping member is spaced from said planar part of said third portion of said supporting member.

3. The building construction according to claim 1, wherein said retaining means comprises a cage nut.

4. The building construction according to claim 1, wherein said retaining means comprises swaged nut.

5. The building construction according to claim 1, wherein said fastener means comprises a threaded bolt.

6. The building construction according to claim 1, wherein the outer surface of said exterior trim piece is of the same material and color as said outer skins of said panels.

7. The building construction according to claim 1, wherein an interior trim piece snaps over the free vertical edges of said clamping member and hides said fastener means and said clamping member.

8. The building construction according to claim 1, wherein said panels at the corner of said building construction are substantially at right angles to each other.

9. The building construction according to claim 8, wherein said panel legs of said exterior trim piece are substantially at right angles to each other.

10. The building construction according to claim 1, wherein short pieces of said exterior trim piece and shor pieces of said support member are butt joined at their ends to make the sum of their lengths equal to the total height of said corner panels.

11. The building construction according to claim 10, wherein said exterior trim piece is offset vertically from said supporting member so as to provide self alignment both between said short pieces of said exterior trim piece and said short pieces of said support member.

12. The building construction according to claim 1, wherein insulation is inserted between said exterior trim piece and said supporting member.

13. The building construction according to claim 12, wherein insulation is inserted in the interstitial spaces between said supporting member and said clamping member and the edges of said panels.

14. The building construction according to claim 12, wherein said insulation comprises plastic foam.

15. The building construction according to claim 1, wherein an interior trim piece is positioned over said clamping member.

16. The building construction according to claim 15, wherein the vertical free edges of said panel type legs of said clamping member are provided with flanges, and wherein said interior trim piece snaps over said flanges.

17. The building construction according to claim 16, wherein the edges of said interior trim member are provided with flanges, and wherein the edges of said panel type legs of said clamping member adjacent said flanges thereof are bent to provide room for said flanges of said interior trim member.

18. The building construction according to claim 1, wherein each said panel type leg of said clamping member is fastened to the inner skin of its respective panel to provide additional holding of said corner assembly to said panels.

19. The building construction according to claim 18, wherein said panel type legs are fastened to the inner skin of their respective panels by screws.

20. The building construction according to claim 19, wherein said panel type legs are fastened to said inner skin of their respective panels by rivets.

21. In a covering and sealing assembly for concealing and sealing the gap between a pair of edge adjoining wall panels which are disposed at an angle to each other, the combination of an exterior trim piece of V-shaped cross section having two panel type legs, the free vertical edges of which are turned back upon themselves to form a return bent portion; a supporting member for said exterior trim piece, said supporting member comprising first and second portions each of which is adapted to lie adjacent said legs of said exterior trim piece with the free vertical edges thereof received within said return bent portions of said exterior trim piece, said first and second portions being joined by a third portion at least a part of which is planar and lies in a plane which intersects said legs of said exterior trim piece in equal angles, said planar part of said third portion being provided with at least one opening; retaining means positioned in said opening of said planar part of said third portion of said supporting members; a clamping member having a central planar portion which lies in parallel relationship to said planar part of said third portion of said supporting member, said clamping member having panel type legs extending from either side of said central planar portion adapted to lie respectively in parallel spaced relationship to said panel type legs of said exterior trim piece and to said first and second portions of said supporting member, said central planar portion of said clamping member being provided with at least one opening which corresponds to said opening in said planar part of said third portion of said supporting member; the inner face of one panel and the inner face of the other panel defining a first included angle between said panels, said first and second portions of said supporting member defining a second included angle therebetween, said second included angle being less than said first included angle, said panel type legs of said clamping member defining a third included angle therebetween, said third included angle being greater than said first included angle; and fastening means extending through said opening in said clamping member and said opening in said supporting member into said retaining means, whereby the tightening of said fastening means effects a structural tie between said pair of panels by squeezing action of said first and second portions of said supporting member and said legs of said clamping member upon the faces of said panels at the points of contact between said faces and said supporting and clamping members, with the force of said squeezing action being substantially equal to or exceeding the frictional forces between said supporting and clamping members and said outer and inner metal skins, respectively, when intimate contact results therebetween.

22. The covering and sealing member according to claim 21, wherein the vertical free edges of said panel type legs of said clamping member are provided with flanges, and wherein the edges of said interior trim piece are also provided with flanges, the edges of said panel type legs of said clamping member adjacent said flanges thereof being bent to provide room for said flanges of said interior trim piece.

23. The covering and sealing assembly according to claim 21, wherein said central planar portion of said clamping member is spaced from said planar part of said third portion of said supporting member.

24. The covering and sealing assembly according to claim 21, wherein said retaining means comprises a swaged nut.

25. The covering and sealing assembly according to claim 21, wherein said fastener comprises a threaded bolt.

26. The covering and sealing assembly according to claim 21, wherein said retaining means comprises a cage nut.

27. The covering and sealing assembly according to claim 21, wherein each said panel type leg of said clamping member is fastened to its respective panel to provide additional holding of said corner of said covering and sealing assembly to said panels.

28. The covering and sealing assembly according to claim 21, wherein said edge adjoining wall panels are disposed at substantially right angles.

29. The covering and sealing assembly according to claim 21, wherein insulation is inserted in the interstitial spaces between said supporting member and said clamping member and the edges of said panels.

30. The covering and sealing assembly according to claim 21, wherein insulation is inserted between said exterior trim piece and said supporting member.

31. The corner and sealing assembly according to claim 30, wherein said insulation comprises plastic foam.

* * * * *